US005354055A

United States Patent [19]

MacKeil

[11] Patent Number: 5,354,055

[45] Date of Patent: Oct. 11, 1994

[54] GOLF CLUB HEAD WITH REARWARD CENTER OF GRAVITY AND DIAGONAL ORIENTATION

[76] Inventor: Robert F. MacKeil, 193 Linden St., S. Hamilton, Mass. 01982

[21] Appl. No.: 967,039

[22] Filed: Oct. 27, 1992

[51] Int. Cl.[5] ..... A63B 53/04

[52] U.S. Cl. ..... 273/80 C; 273/167 G; 273/167 H; 273/169

[58] Field of Search ..... 273/186.2, 187.4, 187.6, 273/193 R, 194 A, 194 B, 77 R, 162 R, 164.1, 164.2, 167 R–177 A, 129 K, 80 A, 80 C; D21/214–220

[56] References Cited

U.S. PATENT DOCUMENTS

| | | | |
|---|---|---|---|
| 684,532 | 10/1901 | Vehslage | 273/169 |
| 1,096,359 | 5/1914 | Dwight | 273/169 |
| 1,133,129 | 3/1915 | Govan | 273/171 |
| 1,409,966 | 3/1922 | Plant | 273/80 C X |
| 1,485,685 | 3/1924 | McMahon | 273/169 |
| 1,503,291 | 7/1924 | Rimmer | 273/169 X |
| 1,525,148 | 2/1925 | Pickop | 273/169 |
| 1,683,639 | 9/1928 | Vaile | 273/169 X |
| 3,595,577 | 7/1971 | Hodge | 273/80 C |
| 3,625,518 | 12/1971 | Solheim | 273/167 A X |
| 4,471,961 | 9/1984 | Masghati et al. | 273/169 X |
| 4,944,515 | 7/1990 | Shearer | 273/171 X |

FOREIGN PATENT DOCUMENTS

| | | | |
|---|---|---|---|
| 2185690 | 7/1987 | United Kingdom | 273/80 C |
| 2195546 | 4/1988 | United Kingdom | 273/167 R |
| 2212406 | 7/1989 | United Kingdom | 273/167 R |

*Primary Examiner*—V. Millin
*Assistant Examiner*—Sebastiano Passanti

[57] ABSTRACT

A "wood" type golf club head, of elongated and tapered shape, wherein the front profile and mass is diagonal to the ground and perpendicular to the shaft, thereby properly aligning the striking face to a normal ball striking pattern and moving the center of gravity rearward.

3 Claims, 4 Drawing Sheets

F1 = F SIN ⊕
F2 = F COS ⊕

| DISTANCE FROM C.G. TO FACE | F1 LATERAL FORCE | F2 FORCE AT CONTACT POINT |
|---|---|---|
| .750" | .707 | .707 |
| .875" | .650 | .759 |
| 1.000" | .600 | .800 |
| 1.125" | .555 | .832 |
| 1.250" | .514 | .857 |
| 1.375" | .479 | .878 |
| 1.500" | .447 | .894 |
| 1.750" | .394 | .919 |
| 2.000" | .351 | .936 |
| 2.250" | .316 | .949 |

GOLF CLUB HEAD WITH REARWARD CENTER OF GRAVITY AND DIAGONAL ORIENTATION

BACKGROUND OF THE INVENTION

1. Field of the invention

The subject invention relates to golf club heads of the "wood" or hollow "metalwood" type, but including clubs of other suitable materials, wherein an object of the design is to move the center of gravity away from the striking face.

2. Prior Art

Golf club heads are generally designated as being "woods" or "irons". The primary difference, affecting performance, being that the "wood" types possess a center of gravity some distance behind the striking face.

The "woods" are further divided into generally solid types and hollow types. For purposes of this discussion I will refer to them as "woods" and "metalwoods" respectively.

The hollow "metalwood" head possesses greater axial inertia than the solid "wood" type because of its perimeter weighting but its center of gravity is more forward in a less advantageous position because of the necessity of strengthening the striking face.

The modern wooden club head of about seven ounces has a center of gravity approximately 1" behind the striking face. Some clubmakers utilize available excess weight by placing a backweight of about one ounce at the very back of the clubhead. This moves the center of gravity rearward about $\frac{1}{4}$" as compared to the more common practice of placing the weight in the bottom center or at the sides for "heel and toe" weighting.

It is commonly supposed that this rearward center of gravity relates primarily to "gear effect" as described in O'Hara, U.S. Pat. No. 1,299,014 . This is not the case as "gear effect" is merely incidental to the force vector angle being improved as the center of gravity moves rearward. See FIGS. 1, 2 and 3.

The force vector angle is that angle formed by a line drawn from a point near the club head center of gravity to the point on the club face struck by the ball and a second line drawn from the point near the center of gravity, extending along the path of the swing and intersecting the club face at its approximate center.

The following is a list of misconceptions, embodied in the prior art, which when examined in the light of the subject invention, will explain the superior performance of said invention;

a. That the rearward center of gravity of "woods" is primarily related to "gear effect".
b. That a center of gravity too far from the face, will cause too much "gear effect".
c. That there is a value to "heel and toe" weighting in a "wood" type head.
d. That the head will rotate around the center of gravity when struck away from said center of gravity.
e. That a center of gravity lower than normal will necessarily drive the ball too high.
f. That the shaft need not be considered in calculations of club head action at impact.
g. That a normal ball strike pattern will coincide with the shape and orientation of a normal face.

While I do not claim that all clubmakers are suffering from all the foregoing misconceptions and half-truths, I have to assume that they all embrace some of them as they have never produced a club head of the configuration and weight distribution of the subject invention.

The "Rules of Golf" as promulgated by the U.S.G.A. require that the width of the club head, from the heel to the toe, be greater than the depth from face to back. Any easily measured difference will satisfy the rule.

SUMMARY OF THE INVENTION

The subject invention relates to golf club heads of the "wood" and hollow "metalwood" types.

The primary attributes of the subject invention are a center of gravity moved substantially rearward, thereby improving the angle of attack on off center hits, and a diagonal orientation to the ground of the striking face, the back weight, and the body of the clubhead, thereby aligning the mass of the club head to a normal ball striking pattern. Although the orientation to the ground will change with the shaft length, the head will remain generally perpendicular to the shaft.

An additional benefit of the diagonal orientation is that it causes the lowest point of the club head to be located substantially toward the heel rather than aligning with the center of gravity as in a conventional design. This mitigates the tendency for the club head to fly open when it accidently touches the ground before striking the ball.

The shifting of weight rearward is made possible, in part, by the recognition that a normal ball strike pattern will show no significant number of hits low on the toe or high on the heel of the club face. This permits a reduction and re-orientation of the club face and front profile which is extended rearward creating a generally slimmer profile and allowing for significant weight savings to be utilized to extend and weight the back of the club head. Additional weight is saved by providing a horizontal hole, or holes behind the face insert.

The general shape of the clubhead, as viewed from the top, FIG. 3, is that of a truncated teardrop. A large backweight of about 2 ounces or more is placed at the extreme rear.

In addition to the improved angle of attack, or "force vector angle", the rearward center of gravity increases the distance between the primary point of rotation of the head weight, near the center of gravity, and the secondary point of rotation at the shaft. This is a key factor in increasing the stability of the club head during mishits.

DETAILED DESCRIPTION

Throughout this specification the terms striking face, shaft, back, toe, heel, back weight, neck, shaft socket or other terms shall have the same meaning as defined by the U.S.G.A. in the "Rules of Golf" rule book. The width of the club head from "heel to toe" is defined as the horizontal distance between a vertical line tangent to the outermost point of the toe and a second vertical line rising from a horizontal plane on which the club head is resting, and said second vertical line meeting the back of the neck at a point $\frac{5}{8}$ inches above said horizontal plane. The club head is presumed to be in the normal "set up" or "playing" position.

The "face to back" distance is similarly measured between vertical lines tangent to, and not intersecting, the said face and back. As above, the club head is in the "set up" position.

The "face" or "striking face" is that surface of the club head that is designed and intended to contact the ball. The "back" is that area on the opposite side from the face. The toe area is that part of the club head that is away from the golfer in the set up position and the heel is that area that is opposite the toe and toward the golfer. A back weight is any weight added to the back area and usually of brass or lead. The shaft is a hollow tube attached to the club head by insertion into a shaft socket located in the neck.

The terms "toe hit" or "heel hit" mean the club face meets the ball on that part that is toward the toe or heel. The loft angle is that angle formed by a vertical line and a line tangent to the center of the face when the club head is in the playing position and both lines are in the same plane.

Figure 3:
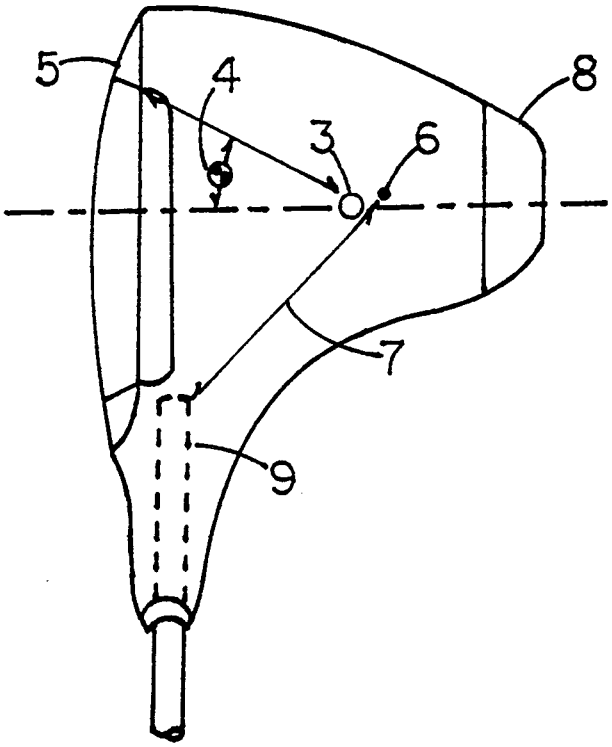
FIG. 3 and 4 are top views of the subject invention showing its shape to be that of a truncated tear drop.
Figure 6:
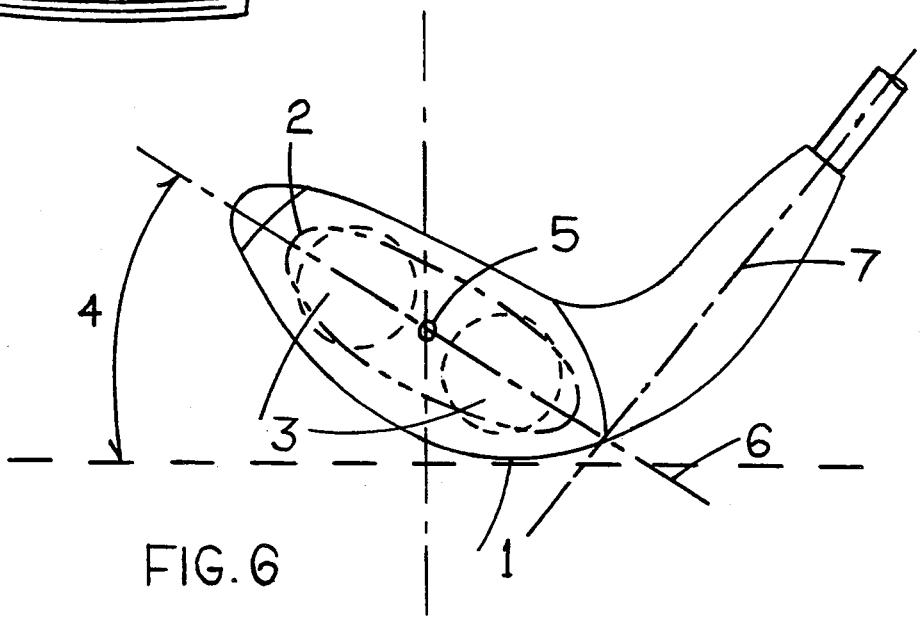
FIG. 6 is a front view of the subject invention showing it to be of reduced profile at areas high toward the heel and low toward the toe and showing holes behind the face insert and showing the normal ball strike pattern as a dotted line. The face insert is removed.
Figure 7:
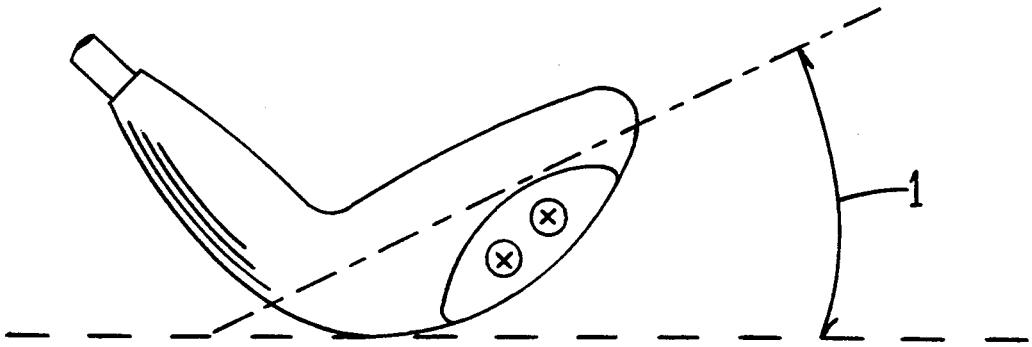
FIG. 7 is a rear view showing the orientation of the head and back weight to be perpendicular to the shaft.
Figure 8:
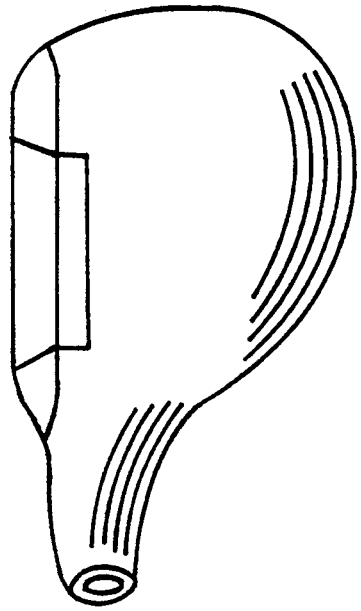
FIGS. 8, 9 and 10 are top, side, and front views of club heads of conventional design for comparison purposes.
Figure 9:
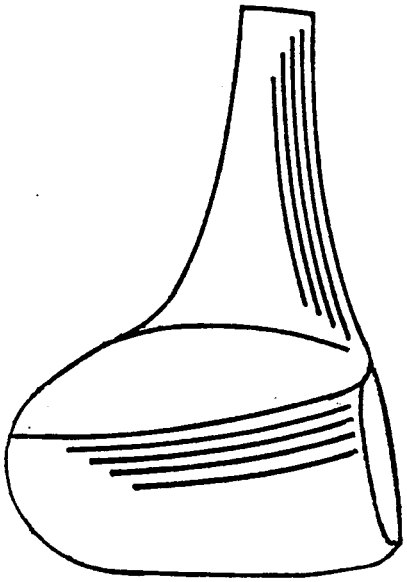

The primary characteristics of the invention are an extremely rearward center of gravity, FIG. 3, note 3, and a diagonal orientation of the club head mass, to the ground, FIG. 6, note 4 and FIG. 7, note 1. The former causes the force vector angle of mishits to be decreased, FIG. 3, note 4, and the distance between the primary and secondary points of head rotation to be increased, FIG. 3, note 7, thereby greatly increasing stability when the ball is struck at a point some distance from the face center, FIG. 3, note 5, as example. The latter results in more powerful shots due to proper alignment of club head mass and club face to the ball striking pattern, FIG. 6, note 2. To create the diagonal orientation to the ground, in the playing position, the longitudinal centerline of the face and mass, FIG. 6, note 6, must be aligned to the centerline of the shaft, FIG. 6, note 7, in a generally perpendicular position. All prior art has consistently attempted to align the club head in a level to the ground position.

Figures 1, 2:
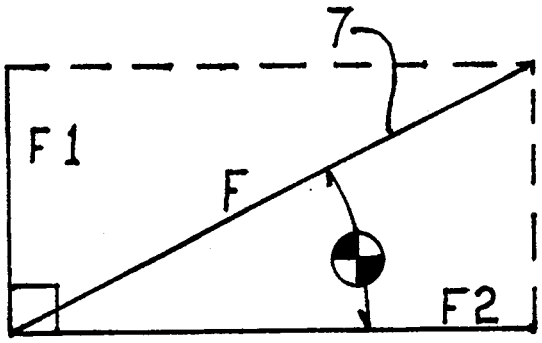
FIG. 1 is a diagram and formula for calculating concurrent components of a single force.
FIG. 2 is a chart demonstrating the application of the formula of FIG. 1 to a $\frac{3}{4}$ mishit.

The chart of FIG. 2 shows the effect of moving the center of gravity rearward. The important number is F-1 because this force is expended in twisting the club head off line. The main purpose of this design is to drive the ball straighter by reducing the twisting force. Gain in distance due to greater forward force, F-2 is an important but secondary consideration.

This decreasing of the force vector angle, FIG. 3, note 4 for example, is the true reason for a rearward center of gravity and not for "gear effect" as is commonly supposed as in misconception "a" above.

Figure 4:
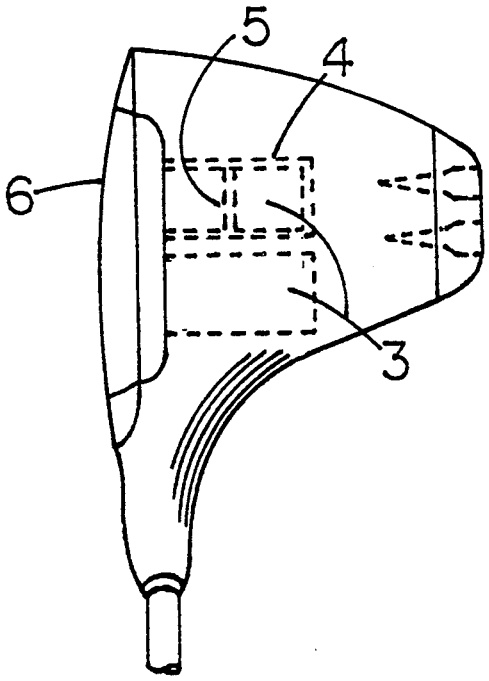

Contrary to misconception "b", it is not possible to create too much "gear effect" by moving the center of gravity rearward because as the force vector angle becomes more acute the tendency to twist is reduced and "gear effect" is likewise reduced. As with any "wood" type head the bulge curve, FIG. 4, note 6, may be adjusted to regulate "gear effect".

Contrary to misconception "c", there is little value to "heel and toe" weighting in a "wood" type head because the inertia of "heel and toe" weighting is no greater than that of front to back weighting providing that in both cases the moment arms are of equal length. "Heel and toe" weighting is inferior because it sacrifices center of gravity considerations. The subject invention improves center of gravity location while increasing inertia by elongating the club head and placing available weight at the back, FIG. 3, note 8.

Contrary to misconception "d", the club head does not try to rotate around the center of gravity but rather around a point at which the inertia will be balanced, FIG. 3, note 6. In a head of conventional design this point may be very close to the center of gravity, but in the instant invention this point is more rearward. This is because the center of gravity is determined by the length of the moment arm but inertia is determined by the square of the length of the moment arm. This is directly analogous to static balancing compared to dynamic balancing. Because the weight in the front half of the instant invention is more evenly distributed than in the rear half, the rear half possesses greater inertia. This pulls the point of rotation rearward beyond the center of gravity, FIG. 3, note 6. This further increases the distance from the secondary point of rotation at the shaft socket, FIG. 3, note 9, thereby increasing stability.

Contrary to misconception "e", a low center of gravity need not drive the ball too high. If the center of gravity is far from the face, as in the subject invention, the loft angle is simply reduced to compensate for what would ordinarily be a higher shot. The center of gravity cannot be placed as low in a club head of conventional design because the more oblique force vector angle would create a weak shot of high trajectory when the club face is struck high or in the middle.

A lowered center of gravity may be utilized in the subject invention to provide the advantage of saving shots hit low on the face while still providing satisfactory shots when hit high on the face. My tests have shown that when the center of gravity is lowered, a wooden headed driver of the type herein described requires a loft angle of about 5° or 6° compared to 11° for a conventional driver.

The principle of reduced force vector angle in the vertical plane is the same as in the horizontal plane.

Misconception "f", that the shaft need not be considered in calculations of club head action at impact is only true when the swing is near perfect. Any time the ball is struck off center, the club head will try to rotate around the shaft and around a point near the center of gravity. The subject invention is more stable because the distance between these points is greater, FIG. 3, note 7, and these distances constitute moment arms for the weight of component parts.

Misconception "g", that "a normal ball strike pattern coincides with the shape of a normal face", is untrue and is a key to the redistribution of weight necessary to maximize the performance of the subject invention.

Any golfer of ordinary or better ability will set up with a consistent measure to the ball. The result is that mishits will be high on the toe when the club is swung too low to the ground and low on the heel when the club is swung too high. This results in a predictable ball pattern that will run diagonally across the face on a line roughly perpendicular to the shaft, FIG. 6, notes 2, 4, and 6.

The face of the subject invention is shaped and aligned to reflect the true ball strike pattern, as shown in FIG. 6, note 2. This shape generally constitutes the entire front profile and is carried rearward while tapering to meet the backweight. The bulbous shape of a conventional club head, which is fatter in the middle, is avoided. Whereas the effective hitting area is maximized, a generally slimmer profile may be utilized to save weight. See FIG. 5, 6 and 7.

The diagonal orientation of the club face to the ground places the head weight in proper alignment to a normal ball striking pattern thereby resulting in a stronger more accurate shot.

Additional weight is saved by providing a hole or holes horizontally behind the face insert. See FIG. 4, note 3 and FIG. 6, note 3. The holes may be sleeved and bulkheaded for additional strength as in FIG. 4, notes 4 and 5. The location of the holes is important. The forward location causes the center of gravity to shift rearward, while providing a weight savings that can be utilized to simultaneously increase inertia and further move the center of gravity rearward.

An oversized insert of a lightweight rigid material is used to spread the force of the blow across the face. There are several suitable standard insert materials available that utilize cloth, fiberglass, or carbon fibers embedded in very rigid and durable resins. The more flexible inserts should be avoided.

Figure 5:
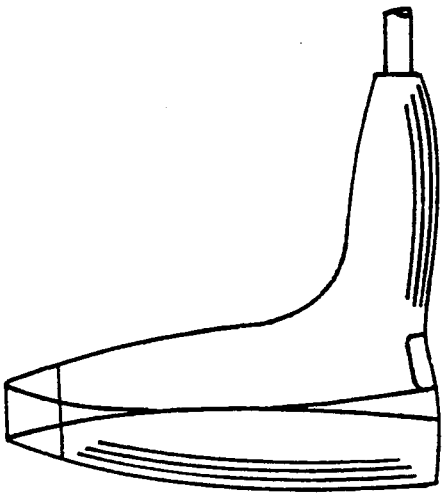
FIG. 5 is a side angle view of the subject invention showing its elongation from front to back and its generally slim profile.

The side profile of the club head, see FIG. 5, is generally slim to save weight and the backweight is preferably low but may be placed higher if desired.

The top view, FIG. 3, shows the club head to be of a teardrop shape but truncated at the rear to permit the greatest amount of weight to be placed as far to the back as possible while ensuring that the depth of the club head does not exceed the width as required by the "Rules of Golf".

The center of gravity of the subject invention, FIG. 3, note 3, and FIG. 6, note 5, is about "2" from the striking face when the club depth is 3.75 inches. The lateral forces applied to the club head during a mishit are approximately 40° of those applied to a wooden head of conventional design. The subject invention also has a substantially greater moment of inertia because more of its weight is in its perimeter and because its shaft socket and center of gravity are more widely separated than conventional designs, FIG. 3, note 7.

Figure 10:
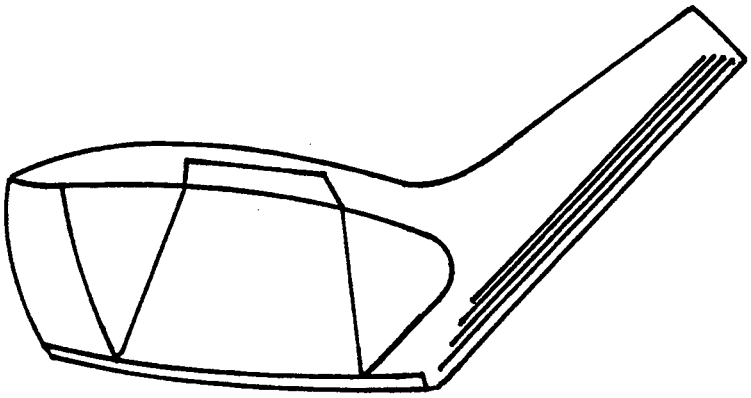

A comparison of FIG. 6 and FIG. 10 demonstrates an additional benefit of the diagonal orientation of the club face. The lowest point of the club head is substantially moved toward the heel rather than aligning with the center of the club head, FIG. 6, note 1. This entirely eliminates the tendency for the club head to fly open when contact is made with the ground. The center of gravity of the club head, being outboard from the point of contact with the ground, FIG. 6, note 5, thereby acts to counter weight the forward force of the shaft when the club head suddenly slows on contact with the ground.

I have chosen throughout the specification and claims to emphasize the diagonal orientation to the ground rather than the perpendicular orientation to the shaft. This is because the heads of all shorter clubs may be said to be generally perpendicular to their shafts but no one has proposed that the heads should not be parallel to the ground in the playing position.

There is another important aspect to the diagonal to the ground feature. Whereas the entire head is tilted to an angle from the ground, FIG. 7, note 1, the striking face is likewise tilted. This causes the backspin axis, which would normally be horizontal, to also tilt to the left. This causes a "hook" spin or bias to the left for a right handed club. This is overcome by moving the center of gravity somewhat more toward the toe than would be desirable in conventional design. This increases the distance between the primary and secondary points of rotation thereby increasing stability. See FIG. 3, note 7.

Because of movement of the center of gravity toward the toe, the mass of the head can more effectively counterweight the neck and shaft assembly when the low point of the club head accidently scuffs the ground. Additionally, an increase in distance between the shaft and center of gravity increases the likelyhood that mishits will be inboard, rather than outboard of the center of gravity. This type of hit is more stable because it causes the primary and secondary points of rotation, FIG. 3, notes 6 and 9, to travel counter clockwise and clockwise respectively thereby negating one another.

The subject invention may be applied to "metal woods" other hollow heads but because their weight is proportional to surface area rather than volume the weight savings of the design are not as great. Whether of hollow or solid type construction, the diagonal orientation of the face and mass will enhance the performance of the club head.

In general, the advantages of the subject invention may be realized at a cost comparable to traditional clubs without resorting to high cost materials or construction.

I claim, as my invention;

1. A golf club comprising:

a golf club shaft and a "wood" type golf club head;

said club head including a hollow, solid, or partially hollow main body having a toe, a heel, a top, a sole, ball striking face and back portion;

said heel including a neck portion having an opening adapted to receive said golf club shaft;

said main body, when viewed from a top view, having a generally teardrop shape extending rearwardly from a plane containing said ball striking face towards said back portion; the depth of said main body as measured from said ball striking face to said back portion being nearly as deep as the width of said main body as measured from said heel to said toe;

said main body being shaped such that a longitudinal centerline of the front profile, as viewed looking at the striking face, is substantially perpendicular to a longitudinal axis passing through said shaft, and said longitudinal centerline is diagonal to a horizontal plane approximating the ground when the club is in the ball striking or address position.

2. A golf club according to claim 1 wherein said main body is partially hollow and includes at least one generally horizontal cavity extending rearwardly of a plane containing said striking face, whereby the center of gravity of the head is moved away from the striking face.

3. A golf club according to claim 1 wherein said club head is partially hollow and further includes a backweight positioned adjacent to the back portion of the main body.

* * * * *